US005695574A

United States Patent [19]

Falardeau et al.

[11] Patent Number: 5,695,574

[45] Date of Patent: Dec. 9, 1997

[54] METHOD AND DEVICE FOR CLEANING THE TIES OF RAILROAD TRACKS

[76] Inventors: Randy Falardeau, 2804 rue Larue; Marcel Falardeau, 2806 rue Larue, both of Québec, Québec, Canada, G2A 1A2

[21] Appl. No.: 506,297

[22] Filed: Jul. 24, 1995

[51] Int. Cl.[6] ..... B08B 7/00; B61F 19/00

[52] U.S. Cl. ..... 134/6; 15/54; 15/55; 104/279

[58] Field of Search ..... 134/6; 15/54, 55; 104/279

[56] References Cited

U.S. PATENT DOCUMENTS

| | | | |
|---|---|---|---|
| 570,339 | 10/1896 | Roberts, Jr. | 15/54 |
| 573,842 | 12/1896 | Turner | 15/54 |
| 659,408 | 10/1900 | Morck et al. | 15/54 |
| 2,719,312 | 10/1955 | Hyland | 15/55 |
| 2,727,263 | 12/1955 | Dangremond et al. | 15/55 |
| 2,748,720 | 6/1956 | Kling | 134/6 |
| 4,285,737 | 8/1981 | Price | 134/6 |
| 5,054,401 | 10/1991 | Lindholm | 104/279 |

*Primary Examiner*—Zeinab El-Arini
*Attorney, Agent, or Firm*—Swabey Ogilvy Renault

[57] ABSTRACT

A device for removing debris on upper surfaces of the ties of a railroad track adjacent to the rails thereof includes a frame selectively positioned on the rails such as to be displaced therealong with the frame carrying a pair of cleaning assemblies each including two motorized rotatable brushes adapted to be positioned on both sides of a respective rail such that when the brushes are rotated in their operational position, debris are swept off the upper surfaces of the ties. Each brush is adapted to be vertically displaced with respect to the rails and the ties' upper surfaces and to be horizontally displaced so as to adjust the spacing therebetween in view of the rail's width and the brushing pressure required thereon. A method for removing the debris includes the steps of providing a cleaning device displaceable along the railroad track; positioning the cleaning device on the railroad track; and displacing the cleaning device while in its operational position along the railroad track thereby removing the debris from the ties thereof at least adjacent to the rails of the railroad track.

14 Claims, 4 Drawing Sheets

METHOD AND DEVICE FOR CLEANING THE TIES OF RAILROAD TRACKS

BACKGROUND OF THE INVENTION

1. Field of the Invention

The present invention relates to railroad tracks and, more particularly, to the cleaning thereof which is especially required when some maintenance is done to the railroad tracks, e.g. when damaged ties are being replaced by new ties.

2. Description of the Prior Art

Railroad tracks are constructed with a series of parallel, spaced apart and transversely oriented ties or sleepers which are made of wood and which are laid, preferably in a partly embedded way, on a bed called a ballast. A pair of parallel longitudinal rails are fixedly mounted to the upper surfaces of the ties and extend perpendicularly thereto. The cross-section of the rail comprises a lower base defining a horizontal and plane lower surface, a narrower vertical web, and an upper enlarged head, whereby a pair of horizontally extending channels are defined on the sides of the web between the head and the base. The rails are secured to the ties by way of steel tie plates (also called soleplates) disposed on the upper surfaces of the wooden ties and fixed thereto, for instance, by way of spikes. The tie plates each include a vertical retaining arm in the shape of an inverted "L" such that the vertical section of the arm extends adjacent to the side of the base of the rail and the upper horizontal section of the arm extends over the base, whereby the base is held between the retaining arm and the upper surface of the tie plate with the tie plate being secured to the tie by the spikes.

Over time, the railroad tracks become damaged due to the heavy loads carried thereby and due to the climatic conditions which they are subjected to, especially in cold climate regions. It thus becomes necessary to periodically carry out maintenance operations on the railroad tracks and especially, because of its deteriorating structure, on the wooden ties which must thus be replaced. To do so, the spikes must first be removed so as to free the ties from the tie plates and thus from the rails. The freed ties are then removed by pulling the ties at one of their ends in a direction transversal opposite the general longitudinal orientation of the railroad tracks such that the ties are slidably removed from under the rails. New ties are then slidably introduced under the rails; the tie plates are repositioned between the new ties and the rails and are then secured thereto by engaging the spikes of the tie plates to the new ties while ensuring the engagement of the retaining arms of the tie plates with the bases of the rails such that the rails and the ties are secured together by the tie plates and spikes.

During the removal of the old ties and also when the new ties are positioned under the rails, the railroad track's ballast is somewhat disturbed by the sliding displacement of the ties, whereby broken down stones, rocks, and gravel end up on the new ties thereby requiring that these elements be removed from the upper surfaces of the ties at least vertically opposite the location of the tie plates thereon and this prior to repositioning the tie plates between the rails and the new ties so as to allow the tie plates to be secured with the spikes to the new ties without detritus being present between the upper surfaces of the ties and the lower surfaces of the tie plates and between the upper surfaces of the tie plates and the lower surfaces of the bases of the rails thereby ensuring a stable and firm assembly. This clean-up operation of the railroad tracks has been carried out manually by sweeping the ties and tie plates prior to securing the ties, tie plates and rails together using the aforementioned spikes and retaining arms. Obviously, a more efficient and expedient clean-up system and method is required especially since most of the above-described operations related to the maintenance of the railroad tracks, i.e. replacement of the ties thereof, are done with man-operated motorized machines which are at least partly automated.

SUMMARY OF THE INVENTION

It is therefore an aim of the present invention to provide a device for cleaning railroad tracks.

It is also an aim of the present invention to provide a device for cleaning railroad tracks and, more particularly, for cleaning the upper surfaces of the ties adjacent the rails during maintenance of the railroad tracks including the replacement of ties for ensuring a proper subsequent assembly of the ties and rails together by way of tie plates.

Therefore, in accordance with the present invention, there is provided a device for removing debris on upper surfaces of the ties of a railroad track at least adjacent to the rails thereof, comprising vehicle means adapted to be displaced along the railroad track, cleaning means provided on said vehicle means and adapted to remove at least most of the debris located on at least one tie of the railroad track at least adjacent to at least one rail thereof, said cleaning means having at least an operational position wherein, when said vehicle means is displaced along the railroad track, said cleaning means remove debris from the ties of the railroad track which are encountered one-by-one by said cleaning device.

Also in accordance with the present invention, there is provided a method of removing debris on upper surfaces of the ties of a railroad track at least adjacent to the rails thereof, comprising the steps of:

a) providing cleaning means adapted to be displaced along the railroad track;

b) positioning said cleaning means on the railroad track; and c) displacing said cleaning means while in an operational position thereof along the railroad track such as to remove therefrom at least most of the debris lying at least on the ties at least adjacent to the rails of the railroad track.

BRIEF DESCRIPTION OF THE DRAWINGS

Having thus generally described the nature of the invention, reference will now be made to the accompanying drawings, showing by way of illustration a preferred embodiment thereof, and in which.

DESCRIPTION OF THE PREFERRED EMBODIMENTS

Figure 1:
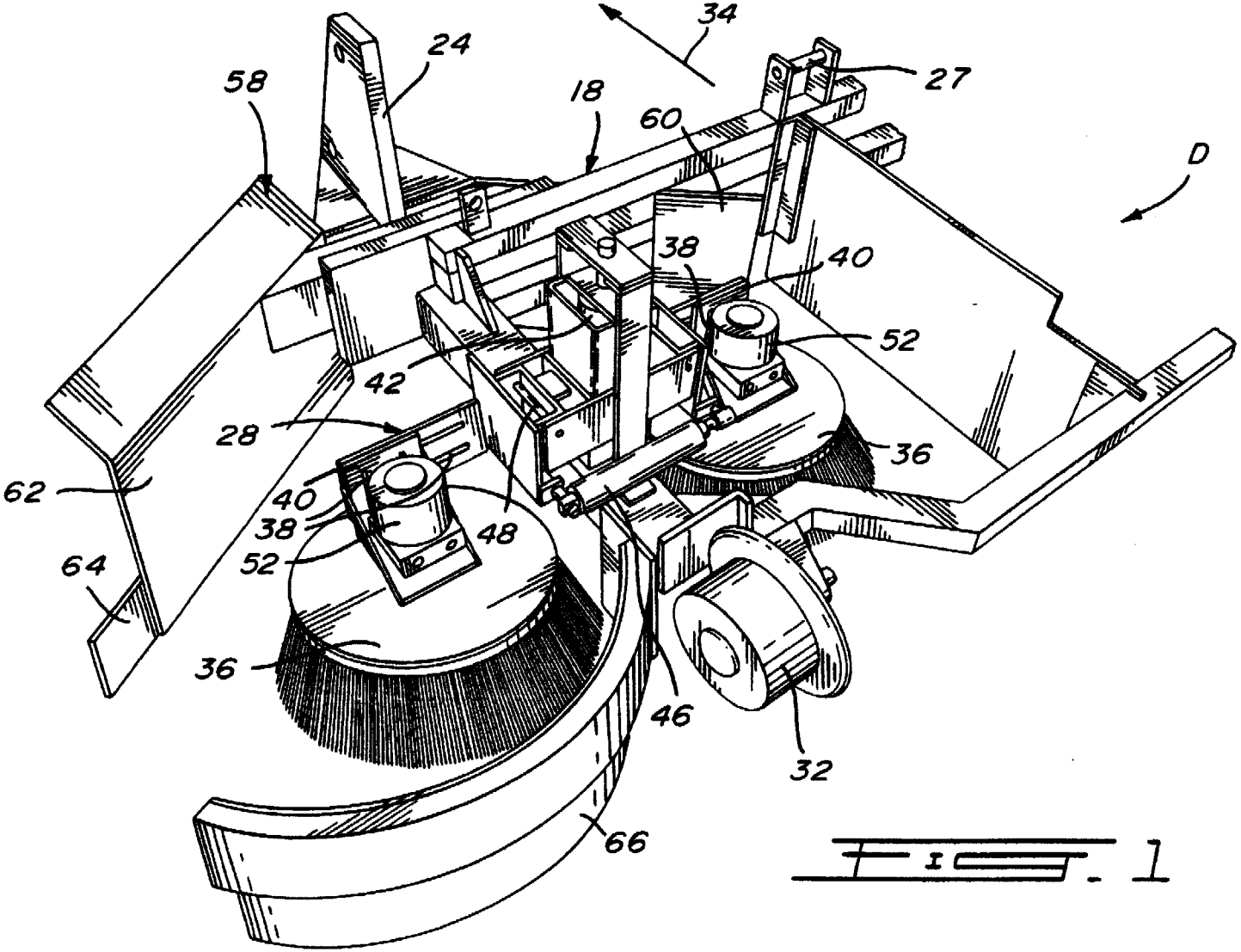
FIG. 1 is a rear perspective view of approximately one half of a device for cleaning railroad tracks in accordance with the present invention, the other half being symmetrical.

FIG. 1 illustrates a cleaning device D in accordance with the present invention for removing debris, such as gravel, broken stones, rocks, etc., which might be present on the ties of a railroad track adjacent the rails thereof especially following the replacement of a tie on the railroad track for maintenance purposes. Indeed, as mentioned previously, the replacement of ties causes material from the railroad track's ballast to be thrown on the ties of the track and such material musty be removed before the tie plates are repositioned between the rails and ties for subsequently connecting the rails to the ties (by way of the tie plates).

Figure 2:
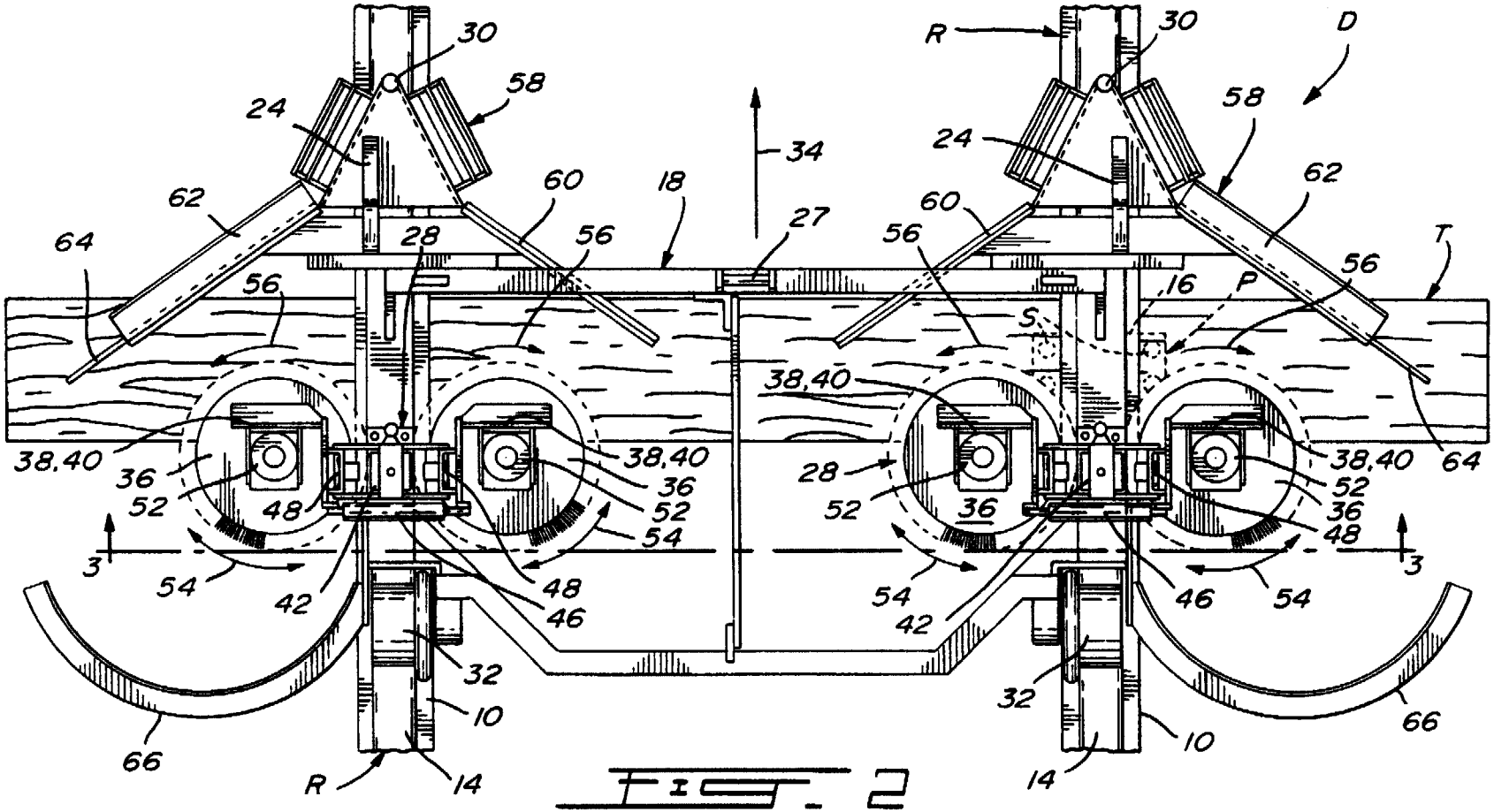
FIG. 2 is a top plan view of the device for cleaning railroad tracks of FIG. 1 which is shown in an operative position on a railroad track.
Figure 3:
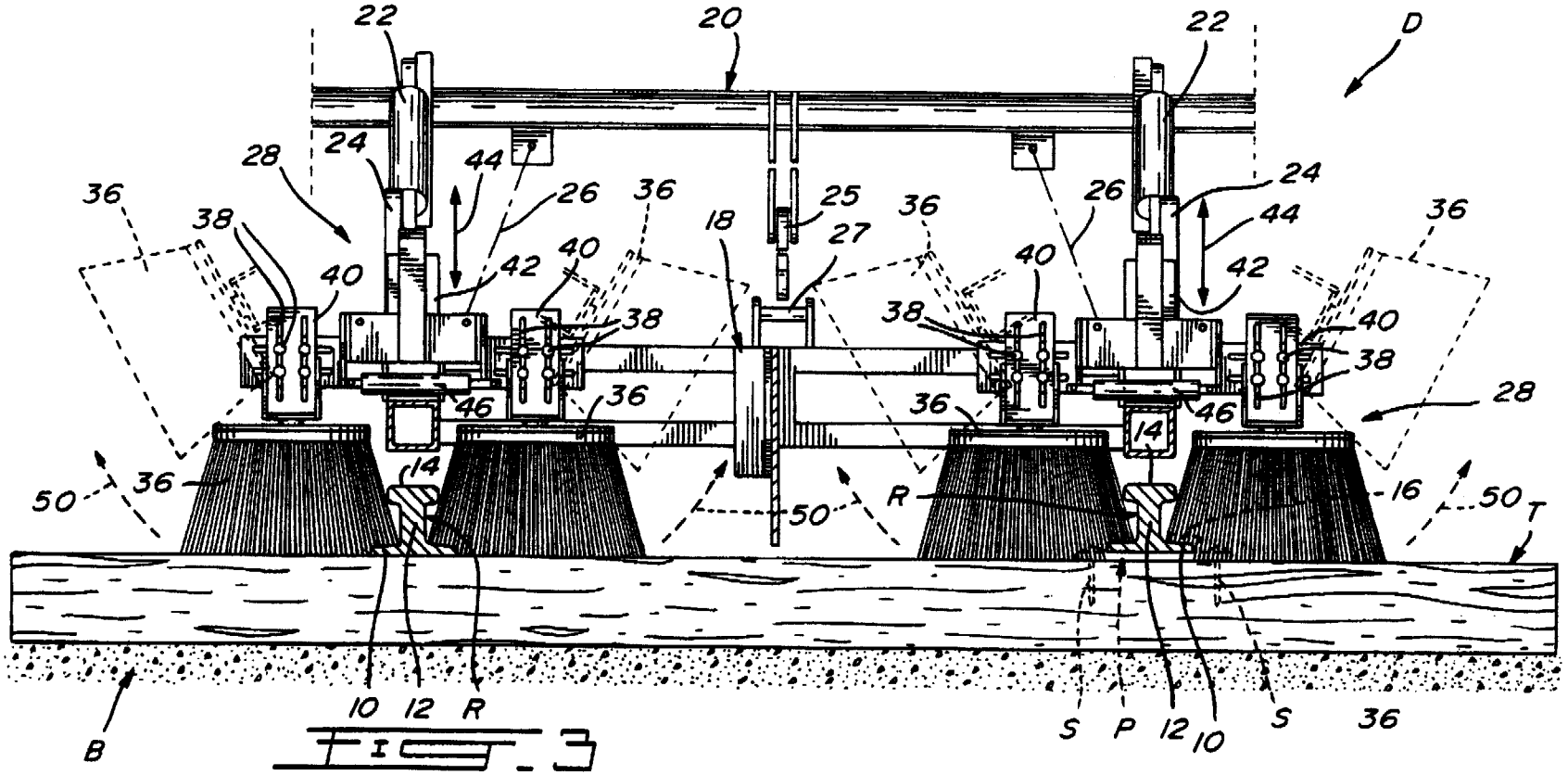
FIG. 3 is a rear elevational cross-sectional view of the cleaning device taken along line 3—3 of FIG. 2 but also showing a raising mechanism therefor, although not showing, for illustration purposes, front plows of the cleaning device and motors for the brushes thereof.
Figure 4:
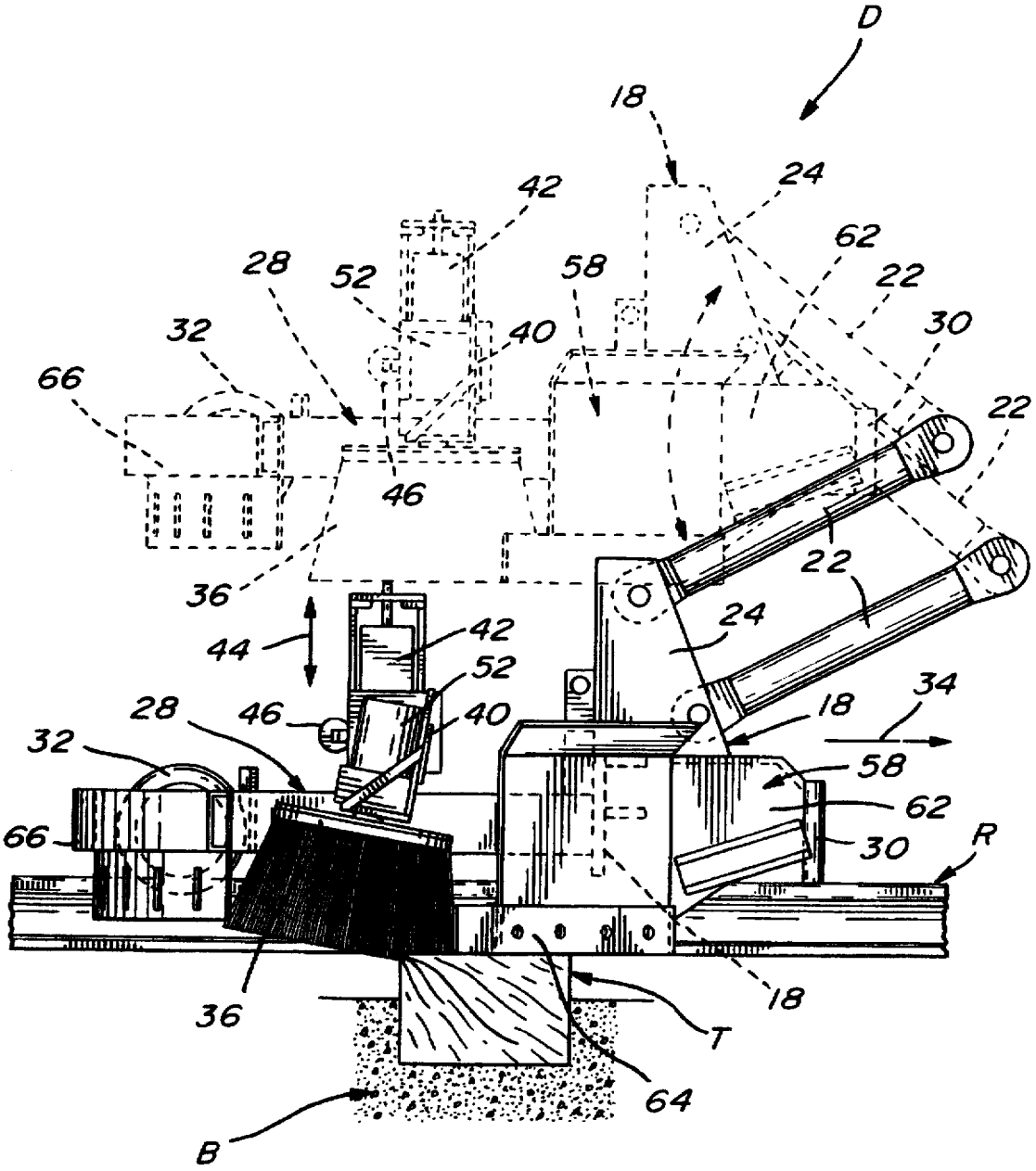
FIG. 4 is a side elevational view of the cleaning device FIG. 3 but showing the front plows and the motors for the brushes thereof.

More particularly, FIGS. 2 to 4 show the cleaning device D in position on a railroad track which includes transversally disposed and parallel ties T which are partly embedded in a ballast B made up of broken down stones, gravel and the like; a pair of elongated rails R; and tie plates P including spikes S to secure the ties T to the rails R. As seen in FIG. 3, the rails R each comprise, when viewed in cross-section, a lower base 10 defining a horizontal and plane lower surface, a narrower vertical web 12, and an upper enlarged head 14, whereby a pair of horizontally extending channels are defined on the sides of the web between the head 14 and the base 10. The tie plates P are each disposed between the base 10 of the rail R and the upper surface of the tie T and are secured to the ties T by the spikes S, with the tie plates P each including a retaining arm 16 which extends substantially over the base 10 of the rail R to fixedly mount the rails R to the tie plates P which are in turn attached to the ties T by the spikes S.

The cleaning device D comprises a frame 18 which carries the cleaning mechanism to be described in details hereinafter and which can be selectively raised and lowered with respect to a transverse boom 20 (see FIG. 3) which is secured to a vehicle (or to a trailer hitched to a vehicle) adapted to displace longitudinally along the railroad track. Such a vehicle can take the form of a "tie renewer", that is the motorized vehicle which installs new ties T under the rails R at the locations of the damaged ties which have been previously removed. More particularly, the boom 20 is fixedly mounted to the rear of the motorized vehicle and is adapted to pull the cleaning mechanism when the latter is in an operative, i.e. cleaning, position on the railroad tracks and is adapted to transport the cleaning mechanism when it is in a raised non-operative position thereof. The boom 20 is linked to the frame 18 by way of two symmetrical pairs of lifting arms 22 each pivotally mounted at the ends thereof to the frame 18 and the boom 20. More particularly, a pair of frame plates 24 are provided on the frame 18 with the rear ends of the lifting arms 22 being connected to the frame plates 24, as best seen in FIG. 4. Each pair of lifting arms 22 in combination with the frame 18 and the boom 20 form a parallelogram linkage. A pair of pneumatic cylinders 26 which are schematically illustrated in FIG. 3 are provided between the frame 18 and the boom 20 to selectively raise or lower the frame 18 with respect to the boom 20 respectively towards the aforementioned lower operative and upper transport positions of the cleaning mechanism which is mounted to the frame 18. In the transport position, the frame 18 is supported in an elevated attitude by a hook 25 centrally mounted to the boom 20 and adapted to engage a horizontal pin 27 secured on the frame 18. The hook 25 engages the pin 27 automatically when the frame 18 is elevated towards its transport position and is automatically disengaged from the pin 27 by way of a pneumatic cylinder (not shown) as soon as the cylinders 26 are actuated for lowering the frame 18 towards its operational position.

The cleaning mechanism comprises a pair of similar and symmetrical cleaning assemblies 28 which are mounted to the frame 18 and are adapted to effect the cleaning of the upper surfaces of the ties T each in the area surrounding a respective one of the two rails R of the railroad track. Indeed, as well seen in FIGS. 2 and 3, each cleaning assembly 28 displaces longitudinally along a respective rail R with a view of cleaning the upper surface thereof at least at the location where the tie plate P will subsequently be positioned to secure together the rail R and the tie T. It is noted that the cleaning operation of the ties is carried out with the tie plates P removed therefrom with the tie plates P (and their spikes S) being shown in phantom lines in FIGS. 2 and 3 only for illustration purposes, that is to shown the configuration of a typical tie plate P and the assembled position thereof to the rail R and the tie T. Indeed, during the cleaning operation, the cleaning assemblies 28 operate such as shown on the left-hand sides of FIGS. 2 and 3 whereat there are no tie plates being shown, with the right-hand sides of FIGS. 2 and 3 being only inaccurate in showing the tie plates P in broken lines as again such tie plates are not in position between the rails R and the ties T during the cleaning operation effected by the present cleaning device D and, more particularly, by the pair of cleaning assemblies 28 thereof, Each cleaning assembly 28 comprises a front nose support 30 and a rear steel wheel 32 which are adapted to engage the rail R such that the cleaning assembly 28 is supported by the rail R while the cleaning device is being continually displaced translationnally and longitudinally along the railroad track, as per arrows 34 in FIGS. 1, 2 and 4.

Each cleaning assembly 28 also comprises a pair of rotatable brushes 36 made of metallic bristles and adapted in the operative position to be disposed on both sides of the rail R, as seen in FIG. 3. The general position of the brushes 36 with respect to the rail R can be first adjusted, both horizontally and vertically, by bolt-and-slot adjusting arrangements 38 provided on a brush supporting structure 40. Furthermore, the pair of the brushes 36 of a cleaning assembly 28 can be selectively raised or lowered by way of a pneumatic cylinder 42 of vertical travel along arrow 44 of FIGS. 3 and 4. Therefore, each brush tandem can be selectively vertically positioned with respect to the rail R by way of a respective cylinder 42.

Moreover, the horizontal position of the brushes 36 with respect to the rail R can also be selectively varied for adjustment purposes with horizontal pneumatic cylinders 46, as best seen in FIG. 1. The brushes 36 and their supporting structures 40 are pivotally displaceable with the horizontal cylinders 46 each about a pivot shaft 48 such that the brushes 36 can be pivotally and adjustably displaced along arrows 50 of FIG. 3 thereby allowing the relative spacing of the brushes 36 of a same tandem to be varied depending on the cross-sectional configuration of the rail R and on the desired pressure to be applied on the rail R which can depend on the cleaning conditions, e.g. the amount of detritus and stones to be removed from the upper surfaces of the ties T, the adherence or stickiness thereof to the ties T which might be greater, for instance, in damp or wet operating conditions, etc. Generally, in their operative cleaning position, the brushes 36 are positioned such as illustrated in FIGS. 2 to 4. Preferably, as seen in FIG. 4, the brushes 36 will be inclined at an angle of approximately 10° with respect to the horizontal such that the front ends of the brushes 36 are lower than the rear ends thereof so as to facilitate the disposal or evacuation of the stones and detritus which are mainly swept by the front ends of the brushes 36.

The brushes 36 are each rotatably driven by a hydraulic motor 52 in a bi-directional fashion, as indicated by arrows 54 in FIG. 2. Preferably, the brushes 36 are rotated along arrows 56 of FIG. 2 such that the stones encountered by the front ends of the brushes 36 are swept inside-out thereby arguably producing a more efficient cleaning of the upper surfaces of the ties T in the vicinity of the intersection thereof with the rails R. It is noted that the hydraulic motors 52 are not illustrated in FIG. 3 to show the afore-described supporting structure 40 and bolt-and-slot arrangements 38.

In front of each tandem of brushes 36, there is provided a generally V-shaped plow 58 which has its apex located substantially at the front nose support 30 of each cleaning assembly 28 and which adapted to remove from and/or distribute on the upper surfaces of the ties T which are adjacent to the rails R the larger stones prior to the brushing operation carried out by the brushes 36 such as to improve the effectiveness of the latter. Each plow 58 includes inner and outer blades 60 and 62, respectively, with the outer blade 62 including a wear plate 64. It is noted that the plows 58 are not illustrated in FIG. 3 but are well seen in FIGS. 1, 2 and 4.

At the rear of each tandem of brushes 36, there is provided a substantially semi-circular guard 66 to limit the outward displacement of the swept stones.

Therefore, the cleaning device D can be transported in its carry position by lifting with the cylinders 26 the frame 18 which is linked to the vehicle boom 20 by the lifting arms 22 and by engaging the boom hook 25 to the frame pin 27 so as to maintain the cleaning device D in its raised position.

When it is desired to use the cleaning device D to clean the newly installed ties T of a railroad prior to laying the tie plates P thereon for subsequently attaching the rails R to the new ties T, the hook 25 is disengaged from the pin 27 and the device D is lowered with the cylinders 26 onto the rails R with the wheels 32 and the nose supports 30 being laid on the rails R so as to be supported thereby during the sweeping, i.e. cleaning, operation in which the cleaning device D is translationnally displaced along the rails R. The brushes are then lowered by way of the vertical cylinders 42 with the horizontal cylinders 46 being extended so that the brushes 36 are sufficiently spaced from each other to allow each tandem to be lowered on each side of a respective rail R as it is pulled by the motorized vehicle and its boom 20 which is linked to the cleaning device D by the arms 22. The horizontal cylinders 46 are then retracted to inwardly displace the brushes 36 such as to bring them in contact with the rail R, as best seen in FIG. 3 and more accurately on the left-hand side thereof which is exempt of its respective tie plate P. The motors 52 are then actuated to cause the brushes 36 to rotate so as to sweep the ties T (and especially the new ties T) as the cleaning device D is displaced translationnally along the railroad track such as to remove therefrom the stones, dirt, earth and other detritus which might have accumulated thereon during the maintenance of the railroad track and, more particularly, during the replacement of ties.

It is also contemplated to replace the brushes 36 with other cleaning means which would be appropriate and efficient for the removal of debris (e.g. stones, gravel, etc.) from the upper surfaces of the ties of the railroad track. For instance, compressed air, preferably in the form of high-pressure jets, could be used to carry out the cleaning operation. A plow assembly could also possibly be used so as to translationnally scrape the debris off the ties; and a cleaning assembly could further be translationnally dragged over the upper surfaces of the ties to remove debris therefrom, with such a device possibly being at least partly flexible while having some stiffness and/or resiliency, to allow the device to follow the contours of the ties.

We claim:

1. A device for removing debris on upper surfaces of ties of a railroad track at least adjacent to rails thereof, comprising vehicle means adapted to be displaced along the railroad track, cleaning means provided on said vehicle means and adapted to be positioned on each side of at least one rail and to displace along said one rail when said vehicle means is displaced along the railroad track, said cleaning means being adapted to act at least right up to said one rail such that said cleaning means remove at least most of the debris located on the ties of the railroad track at least adjacent to said one rail, said cleaning means having at least an operational position wherein, when said vehicle means is displaced along the railroad track, said cleaning means remove debris from the ties of the railroad track which are encountered one-by-one by said cleaning device.

2. A device as defined in claim 1, wherein said cleaning means comprise a pair of rotatable brush means adapted to be disposed on both sides of the rail.

3. A device as defined in claim 2, wherein said brush means are each inclined with respect to the horizontal such that a front end of said brush means is lower than a rear end thereof.

4. A device as defined in claim 2, wherein said cleaning means comprise wheel means adapted to engage the rail such thereby supporting said cleaning means when said vehicle means is displaced along the railroad track.

5. A device as defined in claim 2, wherein there are provided a pair of said cleaning means for simultaneously removing debris from the ties adjacent both rails of the railroad track, each cleaning means comprising a pair of said brush means.

6. A device as defined in claim 5, wherein first lifting means are provided for selectively lifting and lowering said cleaning means.

7. A device as defined in claim 5, wherein second lifting means are provided for pivoting said brush means such as to adjust a distance of each said brush means respective to the rail.

8. A device as defined in claim 2, wherein said cleaning means comprise front plow means and rear guard means.

9. A device as defined in claim 2, wherein motor means are provided for rotating said brush means in a bi-directional fashion.

10. A method of removing debris on upper surfaces of ties of a railroad track at least adjacent to rails thereof, comprising the steps of:

a) providing cleaning means adapted to be displaced along the railroad track;

b) positioning said cleaning means on the railroad track and on each side of at least one rail; and c) displacing said cleaning means while in an operational position thereof along the railroad track with said cleaning means being adapted to act at least right up to said one rail such as to remove at least most of the debris lying on the ties at least adjacent to said one rail.

11. A method as defined in claim 10, wherein in step a), said cleaning means are provided with a pair of rotatable brush means.

12. A method as defined in claim 11, wherein there are provided a pair of said cleaning means each comprising a pair of said brush means, and wherein in step b), said cleaning means are disposed such as to simultaneously remove debris from the ties adjacent both rails of the railroad track.

13. A method as defined in claim 12, wherein in step b), said brush means are positioned such as to be each inclined with respect to the horizontal with a front end of each said brush means being lower than a rear end thereof.

14. A method as defined in claim 12, wherein in step b), said brush means are adjustably positioned on each sides of the rails and relative thereto.

* * * * *

UNITED STATES PATENT AND TRADEMARK OFFICE

CERTIFICATE OF CORRECTION

PATENT NO. : 5,695,574

DATED : December 9, 1997

INVENTOR(S) : Randy Falardeau and Marcel Falardeau

It is certified that error appears in the above-identified patent and that said Letters Patent is hereby corrected as shown below:

Item [30] Foreign Application Priority Data is missing and should read --Jul. 14, 1995 [CA] Canada 2,153,943--

Signed and Sealed this

Nineteenth Day of May, 1998

*Attest:*

*Attesting Officer*

BRUCE LEHMAN

*Commissioner of Patents and Trademarks*